US006953049B2

(12) United States Patent
Kowalke

(10) Patent No.: US 6,953,049 B2
(45) Date of Patent: Oct. 11, 2005

(54) HOSE REEL

(76) Inventor: Steven Kowalke, 603 Sixth St., Baraboo, WI (US) 53913

( * ) Notice: Subject to any disclaimer, the term of this patent is extended or adjusted under 35 U.S.C. 154(b) by 135 days.

(21) Appl. No.: 10/637,895

(22) Filed: Aug. 8, 2003

(65) Prior Publication Data

US 2005/0029384 A1 Feb. 10, 2005

(51) Int. Cl.[7] ..... B65H 75/34

(52) U.S. Cl. ..... 137/355.23; 137/355.16; 137/360; 137/580; 242/376

(58) Field of Search ..... 137/355.16, 355.23, 137/580, 360; 242/376

(56) References Cited

U.S. PATENT DOCUMENTS

| | | | | | |
|---|---|---|---|---|---|
| 2,216,384 | A | | 10/1940 | Brown | |
| 2,367,141 | A | | 1/1945 | Rosenblum | |
| 2,823,074 | A | * | 2/1958 | Bernard, Jr. | 137/355.17 |
| 2,964,258 | A | * | 12/1960 | Kutil | 242/399.2 |
| 3,183,927 | A | | 5/1965 | Weese et al. | |
| 3,433,247 | A | * | 3/1969 | Haselden | 137/355.26 |
| 3,977,429 | A | * | 8/1976 | Stevenson | 137/355.27 |
| 4,520,872 | A | | 6/1985 | Holman | |
| 4,529,148 | A | | 7/1985 | Hesprich et al. | |
| 4,588,083 | A | | 5/1986 | Hunt | |
| RE32,510 | E | * | 9/1987 | Tisbo et al. | 137/355.17 |
| 4,844,373 | A | | 7/1989 | Fike, Sr. | |
| 5,011,034 | A | | 4/1991 | Abel | |
| 5,404,900 | A | | 4/1995 | Fletchall | |
| 5,526,842 | A | | 6/1996 | Christensen | |
| 5,568,824 | A | | 10/1996 | Cordrey | |
| 5,678,596 | A | | 10/1997 | Corallo | |
| 5,678,599 | A | | 10/1997 | Moss | |
| 6,766,821 | B1 | * | 7/2004 | Kovacik et al. | 137/355.23 |

* cited by examiner

*Primary Examiner*—A. Michael Chambers
(74) *Attorney, Agent, or Firm*—Theresa J. Welch; Jeffrey D. Peterson; Michael Best & Friedrich LLP

(57) ABSTRACT

A hose concealing device which hides a hose when it is not intended to be used and which allows access to the hose when it is desirable to use the hose.

22 Claims, 9 Drawing Sheets

FIG. 8
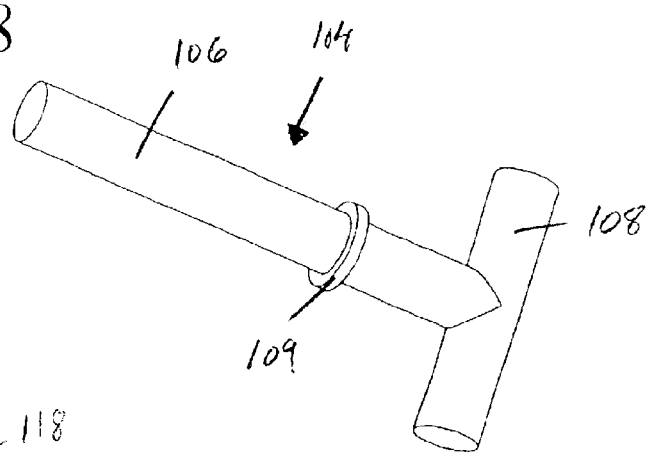
FIG. 9
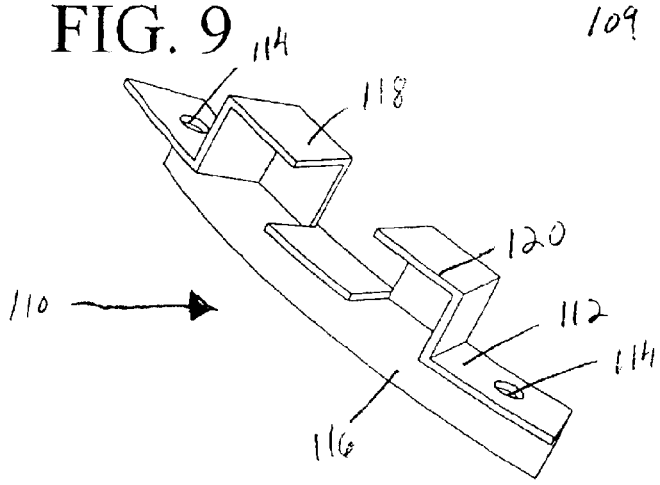
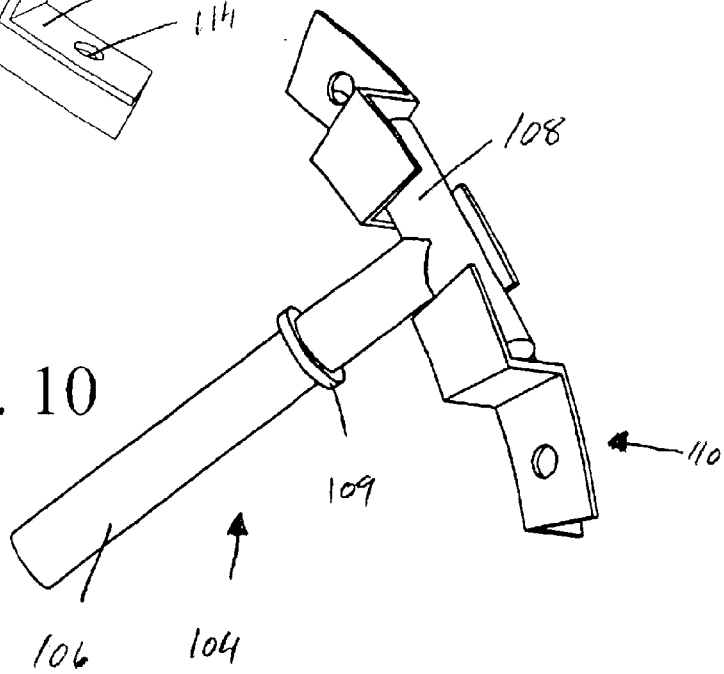
FIG. 10

HOSE REEL

FIELD OF THE INVENTION

The present invention relates to storage devices for hoses and the like and, more particularly, to storage devices that are adapted to conceal a hose or similar piece of equipment until such time as it is desirable to use the hose or other equipment.

BACKGROUND OF THE INVENTION

Garden hoses or other flexible, elongated material which are stored within a container, hanging off of a supporting structure such as a wall on a building, or laying loosely on the ground present many problems. For example, one problem concerns the lack of ease associated with removing a hose from and replacing the hose into a storage device. Another problem concerns the somewhat unsightly appearance associated with certain visible hose storage devices, a loose hose sprawled about the ground, or even a coiled hose placed near a spigot. Another problem is that an exposed hose is subject to damage from pedestrian and vehicular traffic, sharp objects, being chewed up by an animal such as a dog, or other external influences. Another problem relates to safety concerns. An uncoiled hose may get caught underfoot causing a person walking thereover to trip and fall, possibly leading to injury of the person. Moreover, a person could walk or run into a spike or arm extending from a wall from which a coiled hose may be hung, also leading to injury of the person. These are just a few problems generally known in the art. There are other problems.

SUMMARY OF THE INVENTION

The present invention addresses the above-mentioned problems and other problems by providing a new and improved hose storage device.

In one aspect of the invention, the invention provides a hose reel. The hose reel is comprised of two hose reel sections which can be easily assembled into a single reel. Each section is comprised of a side plate and a hub. The hub has a side wall and a top wall, with a center aperture positioned on the top wall. Each hub top wall can also suitably contain a plurality of locking tabs and locking slots, such that the two hose reel sections can be connected to each other via the locking tabs from one section being inserted into the locking slots of the other section.

In another embodiment of the invention, a hose reel system is provided. The hose reel system comprises a hose reel comprised of two sections which can be easily assembled into a single reel. Each section is comprised of a side plate and a hub. The side plates can contain side apertures and a handle aperture. The hub has a side wall and a top wall, with a center aperture positioned on the top wall. Each hub top wall can also suitably contain a plurality of locking tabs and locking slots, such that the two hose reel sections can be connected to each other via the locking tabs from one section being inserted into the locking slots of the other section.

The hose reel system further is comprised of an attachment plate. The attachment plate has a top wall, a bottom wall and a side wall. The side wall of the attachment plate has a bar receiving aperture. The attachment plate also has a reel guide hub having a side wall and a top wall. A center aperture is positioned on the top wall of the reel guide hub. The hose reel is placed on the reel guide hub, such that the hub of one of the sections of the hose reel receives the reel guide hub. The attachment plate can have other features such as a hose groove or grooves, a bar supporting rib or ribs, a hose locking tab or tabs, or a handle.

The hose reel system is also comprised of a swivel bar having an extending section and a top section. The extending section is received by the bar receiving aperture of the attachment plate. The connection of the extending section to the attachment plate can be such that the attachment plate can be rotated around the extending section. The top section of the swivel bar is received by a hinge bracket which is mounted to the inner rim of a tub. The top section of the swivel bar is connected to the hinge bracket in such away that the swivel bar can be rotated in a vertical direction in and out of the tub. This design allows for the hose reel to be lowered and raised out of the tub as the attachment plate is pivoted vertically on the swivel bar which is connected to the hinge bracket of the tub. This design also allows for a portion of the attachment plate to rest on the inner rim of the tub, when the attachment plate is in a horizontal, seated, position over the tub. This design, combined with the rotatbility of the attachment plate on the swivel bar, allows the hose reel to be positioned directly above the tub.

The hose reel system is also comprised of a central pipe which passes through the center aperture of the first reel section hub, the center aperture of the second reel section hub, and the center aperture of the reel guide hub. Each end of the central pipe can have an O-Ring slot. First and second pipe ends can be connected to each end of the central pipe. Each pipe end is comprised of a hose connecting collar and a pipe connecting collar. The pipe connecting collar of each pipe end is designed to receive the end of the central pipe such that the collar covers the O-Ring slot on the end of the central pipe.

Another embodiment of the invention is a hose reel base system which is comprised of the tub, attachment plate, and the swivel bar as described above.

Other features and advantages of the invention will become apparent to those skilled in the art upon review of the following detailed description, claims and drawings in which like numerals are used to designate like features.

BRIEF DESCRIPTION OF THE DRAWINGS

FIG. 8 is a perspective view of one embodiment of the swivel bar of the present invention.

FIG. 9 is a perspective view of one embodiment of the hinge bracket of the present invention.

FIG. 10 is a perspective view of one embodiment of the swivel bar positioned in the hinge bracket of the present invention.

Figure 1:
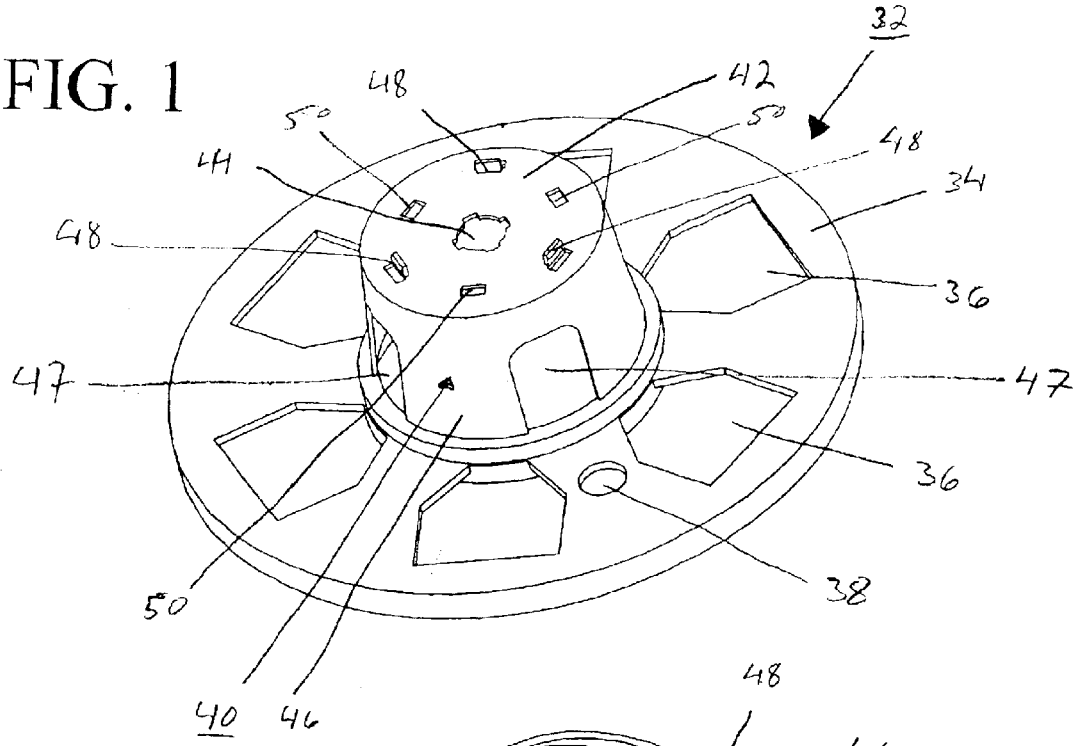
FIG. 1 is a perspective view of one embodiment of a section of the hose reel of the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including", "having" and "comprising" and variations thereof herein is meant to encompass the items listed thereafter and equivalents thereof as well as additional items and equivalents thereof.

BRIEF DESCRIPTION OF THE INVENTION

Referring to the drawings, this invention will be seen to relate to concealing, protecting and neatly storing a hose within a housing or storage container.

Figure 2:
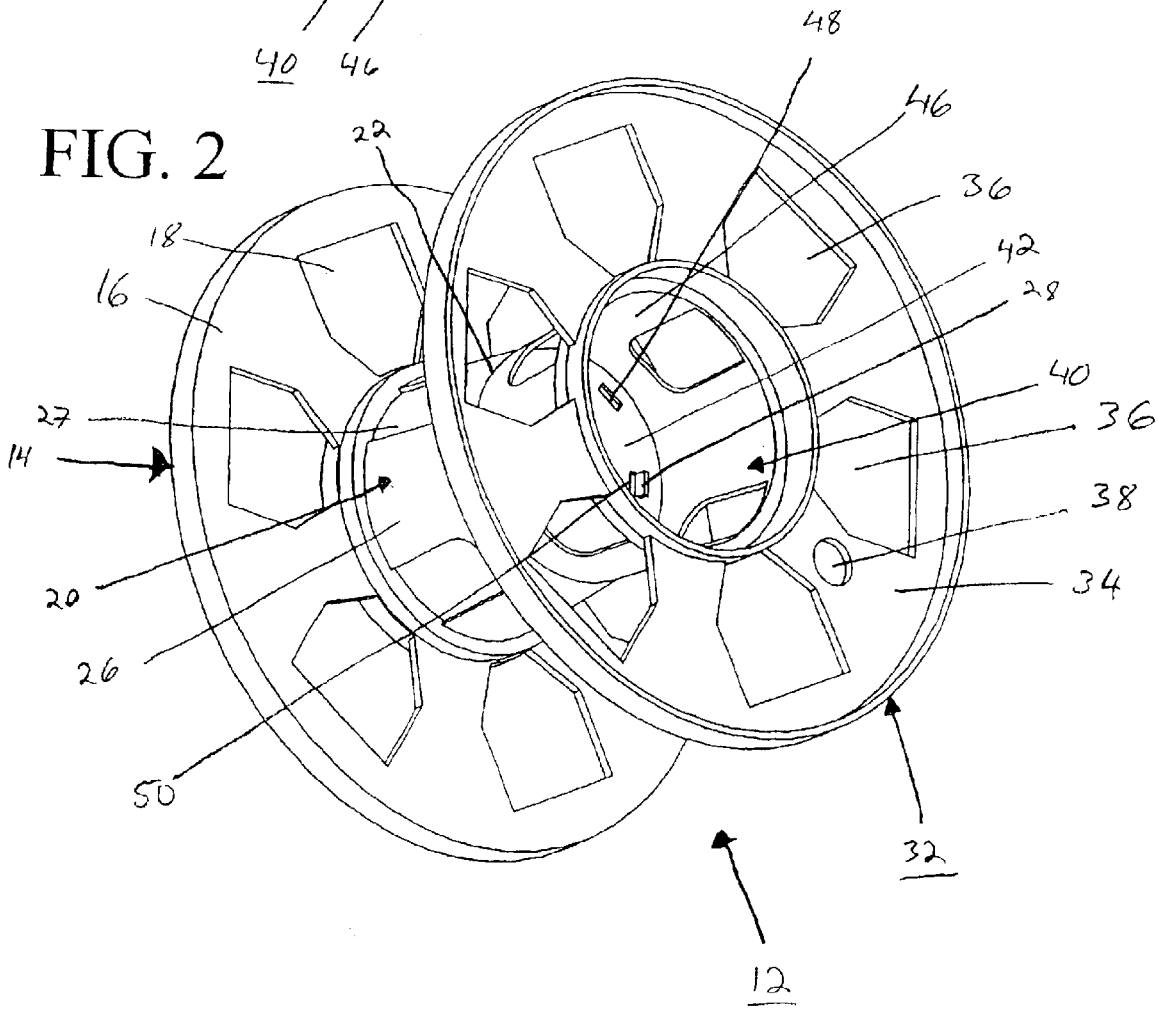
FIG. 2 is a perspective view of one embodiment of the hose reel of the present invention.

One embodiment of the present invention is a hose reel. The hose reel can suitably be made out of any durable material, including plastic. One embodiment of the hose reel of the present invention is shown in FIGS. 1 and 2. The hose reel 12 is comprised of a matching set of reel sections (a first reel section 14 and a second reel section 32). The first hose reel section 14 is comprised of a side plate 16 which has side apertures 18, and a hub 20 which has a side wall 26 which has side wall apertures 27 and a top wall 22 having a center aperture. The top wall 22 also has a plurality of locking tabs 28 and locking slots. The second hose reel section 32 is comprised of a side plate 34 which has side apertures 36 and a handle aperture 38. The hose reel section 32 further comprises a hub 40 which has a side wall 46 which has side wall apertures 47 and a top wall 42 having a center aperture 44. The top wall 42 also has a plurality of locking tabs 48 and locking slots 50.

FIG. 2 shows one embodiment of a complete hose reel assembly 12, in which the first reel section 14 is connected to the second reel section 32. The two reel sections 14 and 32 are connected when the top wall 22 of the first reel section hub 20 is attached to the top wall 42 of the second reel section hub 40 via the plurality of locking tabs 28 of the first reel section 14 being inserted into the plurality of locking slots 50 of the second reel section and the plurality of locking tabs 48 of the second reel section being inserted into the plurality of locking slots of the first reel section.

In another embodiment of the invention a hose reel system is provided. The hose reel system 10 is depicted in FIGS. 11–15. In one embodiment, the hose reel system 10 comprises a hose reel 12, an attachment plate 52, a central pipe 80, a swivel bar 104, a hinge bracket 110 and a tub 124.

Figure 3:
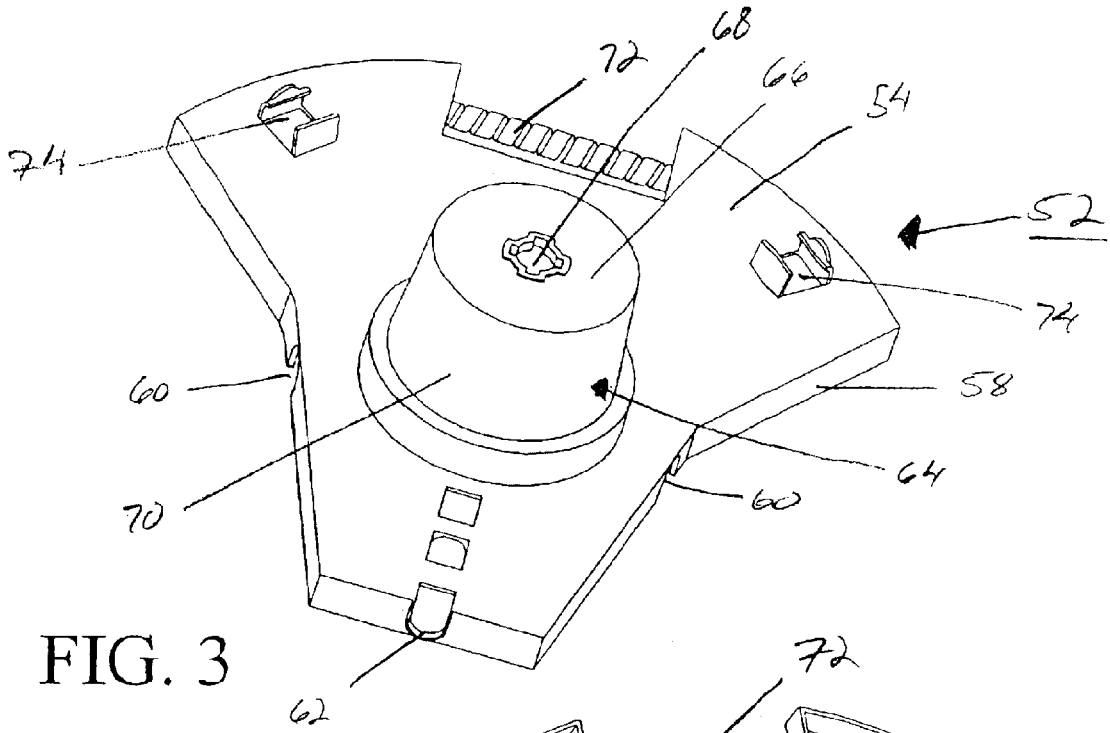
FIG. 3 is a top perspective view of one embodiment of the attachment plate of the present invention.
Figure 4:
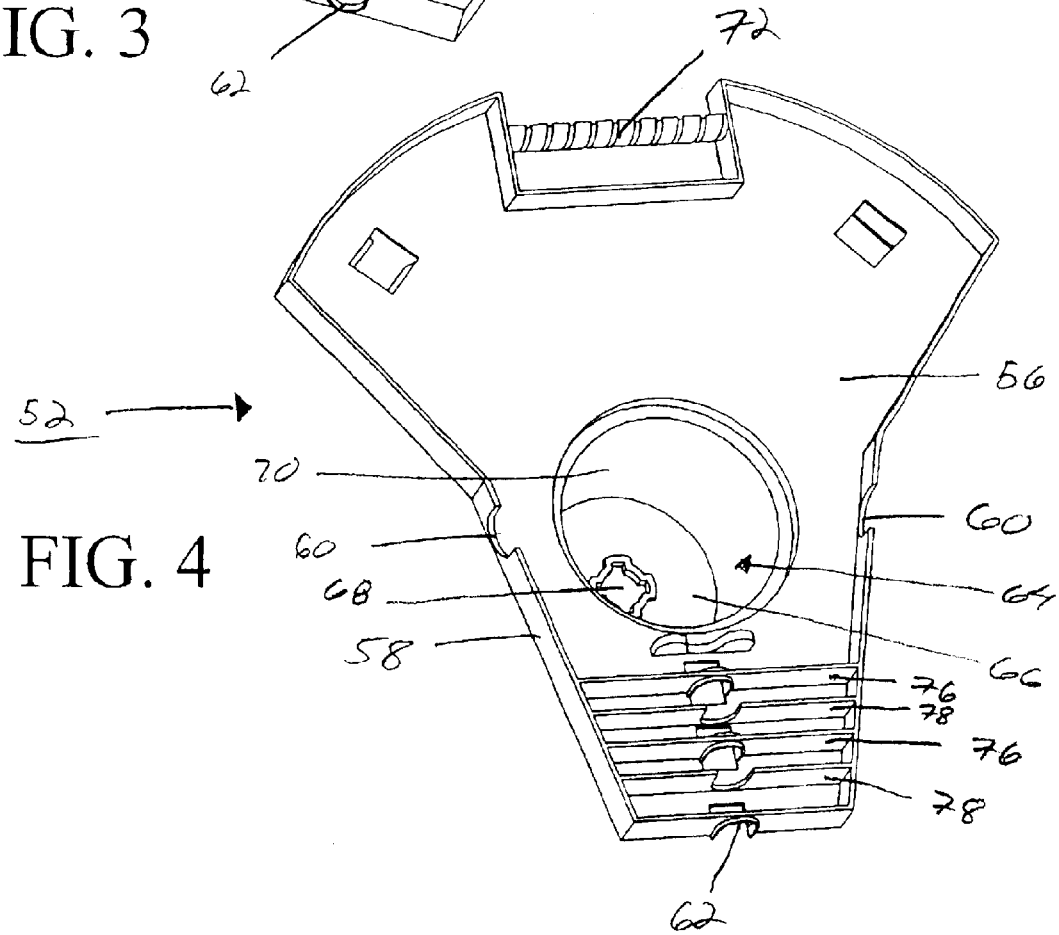
FIG. 4 is a bottom perspective view of one embodiment of the attachment plate of the present invention.

The attachment plate 52 is better shown in FIGS. 3 and 4. The attachment plate 52 is comprised of a top wall 54, a bottom wall 56, and a side wall 58. The side wall 58 has hose grooves 60 positioned on it to allow a hose to lay across the grooves 60 when entering the tub 124, so a lid can be placed over the tub 124. The side wall 58 also has a bar receiving aperture 62. The attachment plate 52 can also contain hose locking tabs 74, to clip a wound hose when not in use, to prevent the hose from uncoiling. The attachment plate 52 can also contain a handle 72.

The attachment plate also contains a reel guide hub 64 designed to be received in a hub 20 of the reel 12, so the reel 12 can rotate around the reel guide hub 64. The reel guide hub 64 has a side wall 70 and a top wall 66 which has a center aperture 68.

The attachment plate also contains bar supporting ribs 76 and a bar supporting bracket 78. The bar receiving aperture 62, bar supporting ribs 76 and bar support bracket 78 are designed to receive the extending section 106 of the swivel bar 104 (shown in FIG. 8). In one embodiment, the bar receiving aperture 62, bar supporting ribs 76 and bar support bracket 78 are designed to snugly attach to extending section 106 of the swivel bar 104 (via a friction fit) to allow the attachment plate 52 to stay connected to the swivel bar 104, while allowing the attachment plate 52 to rotate around the extending section 106 of the swivel bar 104. In another embodiment, the swivel bar 104 can be held in place in the attachment plate 52 via the use of a locking washer placed around the extending section 106 of the swivel bar 104, after the extending section 106 is placed in the attachment plate 52 through the bar receiving aperture 62 and the bar supporting ribs 76, such that the diameter of the locking washer is greater than the diameter either of the bar supporting ribs or the bar receiving aperture 62, so as to prevent the swivel bar 104 from sliding out of the attachment plate 52. This design also allows for the attachment plate 52 to rotate around the extending section 106 of the swivel bar 104.

Figure 5:
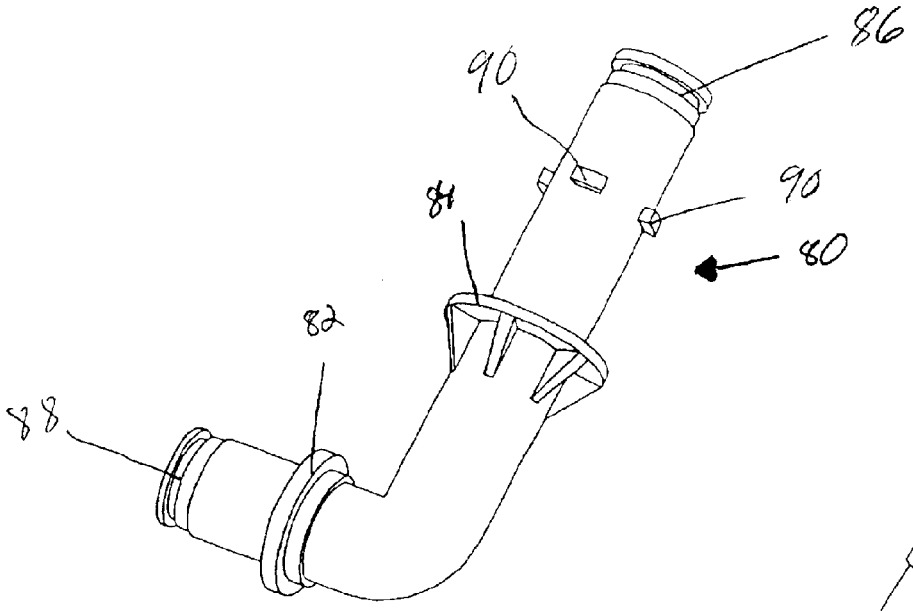
FIG. 5 is a perspective view of one embodiment of the central pipe of the present invention.

The central pipe 80 is better shown in FIG. 5. In one embodiment, the central pipe 80 has a stop collar 82, a stationary collar 84, a first O-Ring slot 86 and a second O-Ring slot 88, and a plurality of pegs 90. The central pipe 80 is designed to pass through the center aperture 44 of the second reel section 32, the center aperture of the first reel section, and the center aperture 68 of the reel guide hub 64. The central pipe 80 is passed through these apertures such that the first O-Ring slot is positioned under the top 66 of the reel guide hub 64, and the stationary collar 84 buts up against the top wall 42 of the second reel section 32.

Figure 6:
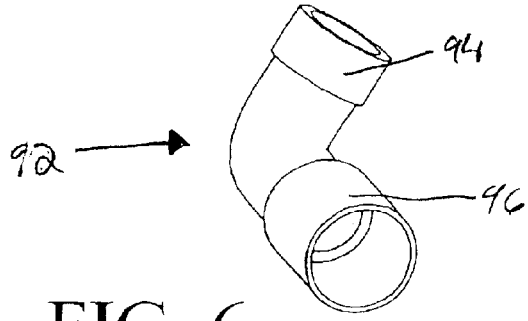
FIG. 6 is a perspective view of one embodiment of the pipe end of the present invention.
Figure 7:
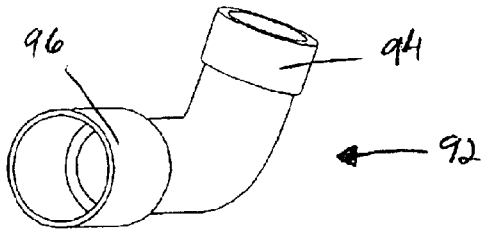
FIG. 7 is a perspective view of one embodiment of the pipe end of the present invention.
Figure 11:
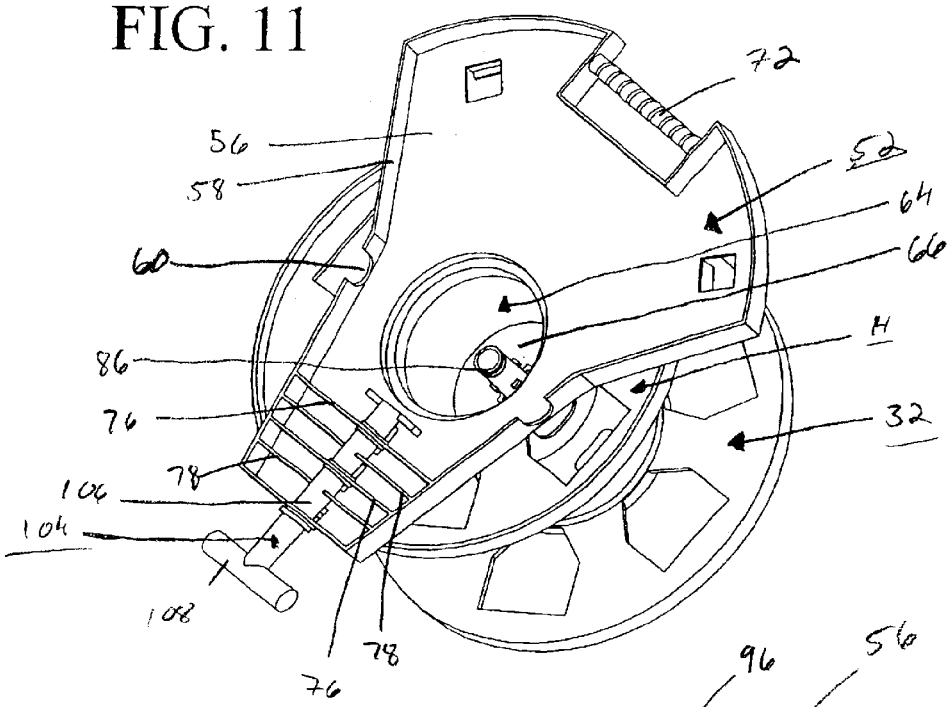
FIG. 11 is a perspective view of one embodiment of the swivel bar, attachment plate, hose reel, central pipe and pipe ends fit together.
Figure 12:
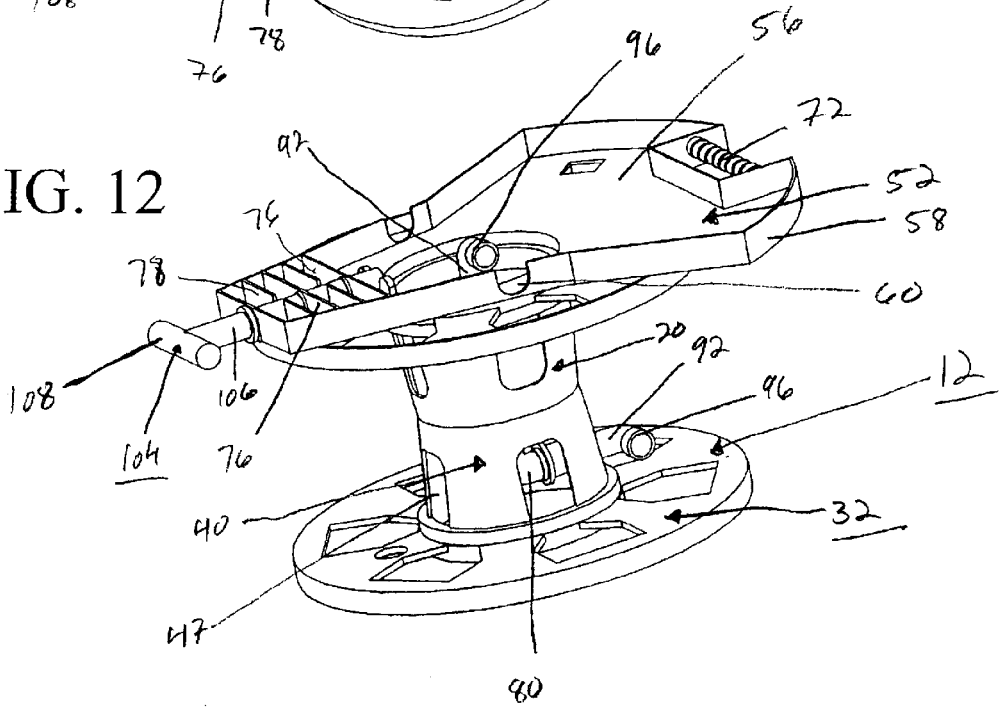
FIG. 12 is a perspective view of one embodiment of the swivel bar, attachment plate, hose reel, central pipe and pipe ends fit together.
Figure 16:
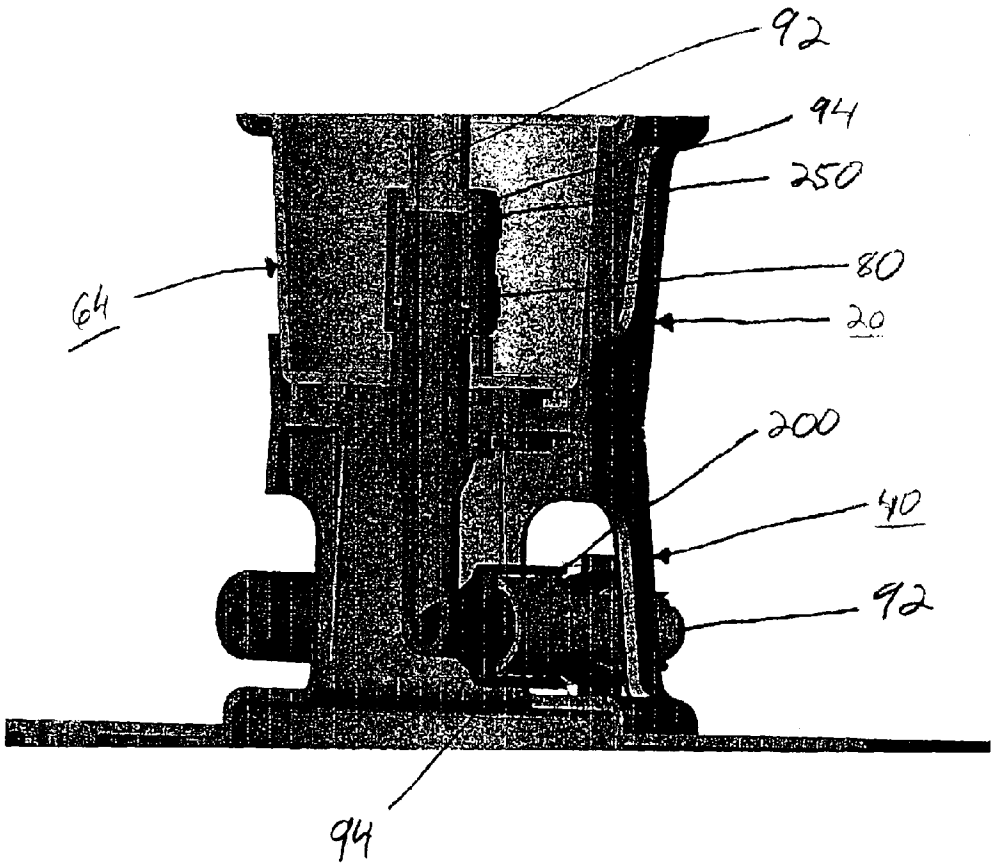
FIG. 16 is a partial cutaway side view of one embodiment of the central pipe, hose reel, pipe ends and clips of the present invention.
Figure 17:
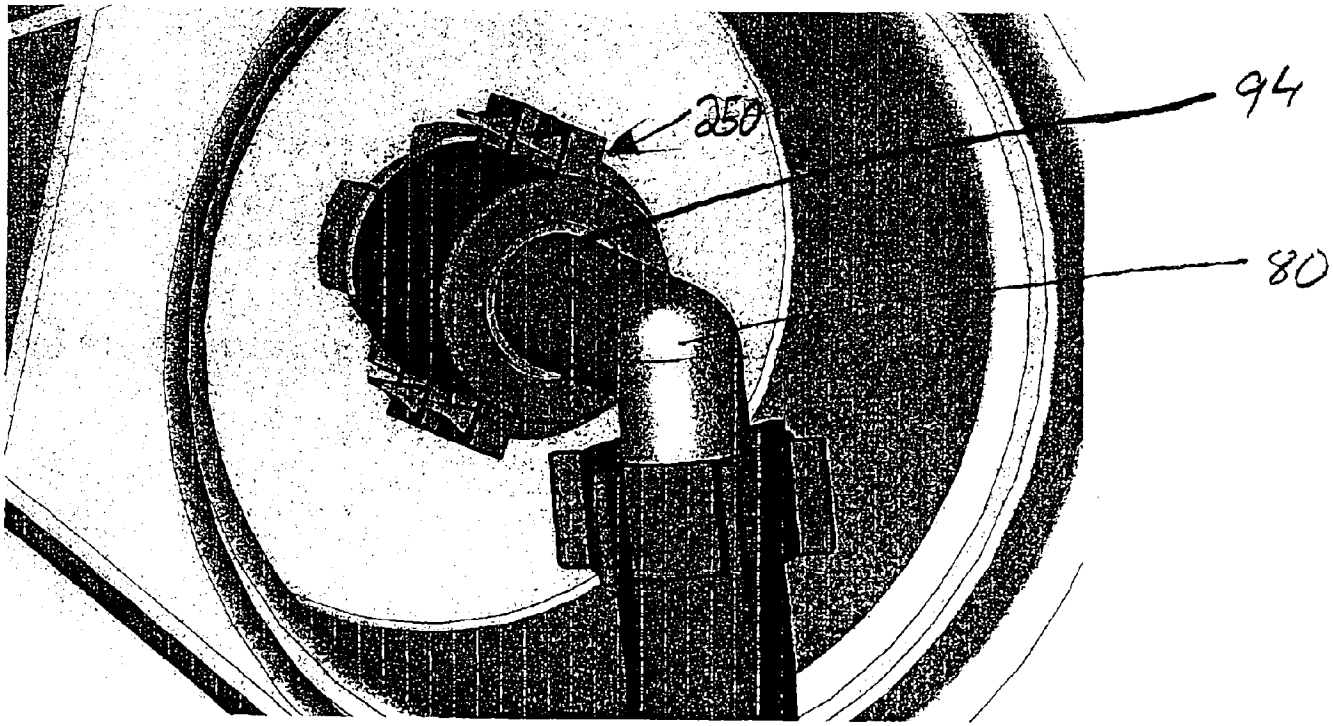
FIG. 17 is a perspective view of one embodiment of a pipe collar clip of the present invention attached to the pipe end and central pipe.

Pipe end sections 92 (best shown in FIGS. 6 and 7) of various lengths are then connected to the ends of the central pipe 80. Each pipe end section 92 contains a pipe connecting collar 94 and a hose connecting collar 96. The hose connecting collar 96 is suitably threaded to connect to the standard threads of a hose. The pipe connecting collar 94 is designed to receive and connect to the ends of the central pipe 80. The pipe connecting collar 94 is designed to cover the O-Ring slots 86 and 88, to provide a water tight seal, while allowing the pipe end sections 92 to rotate around the central pipe 80. The pipe end sections 92 can be attached to the central pipe 80 using any standard fastener means for such a rotating connection. Suitably, a clip design can be used such as clip collar 200 shown in FIG. 16 (wherein the clip collar is connected to the central pipe 80) of the clip collar 250 shown in FIGS. 6 and 7 which surrounds the pipe connecting collar 94 of the pipe end 92, and the pegs 90 of the central pipe 80.

The swivel bar 104 is shown in FIGS. 8 and 10. The swivel bar comprises an extending section 106, a top section 108 and a stop collar 109. As delineated above, the extending section 106 is inserted into the attachment plate 52 through the bar receiving aperture 62. When fully inserted, the stop collar 109 (which has a diameter greater than the bar receiving aperture 62) abuts the side wall 58 of the attachment plate 52 around the bar receiving aperture 62. The top section 108 of the swivel bar 104 is received by the hinge bracket 110 (best shown in FIGS. 9–10). The hinge bracket 110 is comprised of a base plate 112 which has connecting apertures 114, a front plate 116, a first tab section 118 and a second tab section 120. The hinge bracket 110 is mounted in turn to the inner rim 126 of the tub 124 (best shown in FIGS. 13 and 14). The tub 124 contains an inner rim 126, an outer lip 128, and stationary stops 130. The tub 124, hinge bracket 110 and swivel bar 106 are arranged so that the swivel bar 106 can hinge around the hinge bracket 110.

Figure 13:
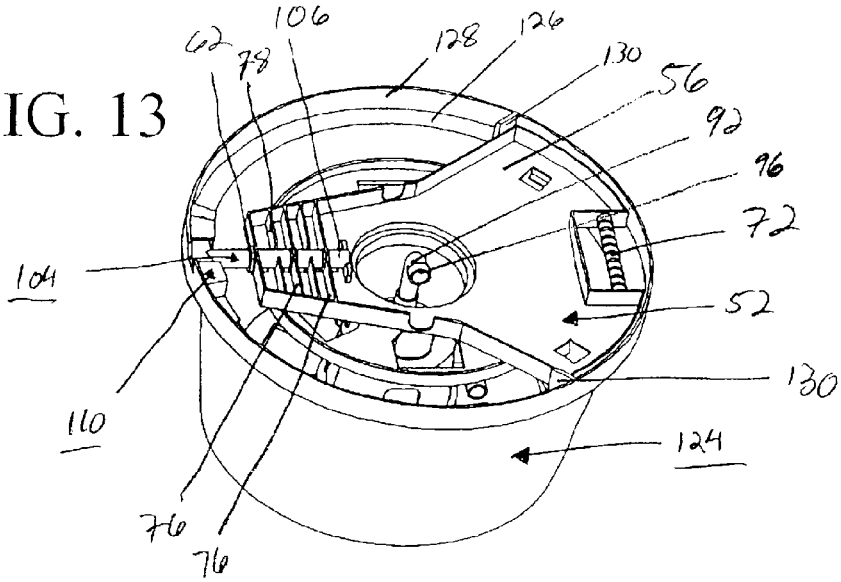
FIG. 13 is a perspective view of one embodiment of the hose reel system of the present invention with the attachment plate in the seated, closed, position.
Figure 14:
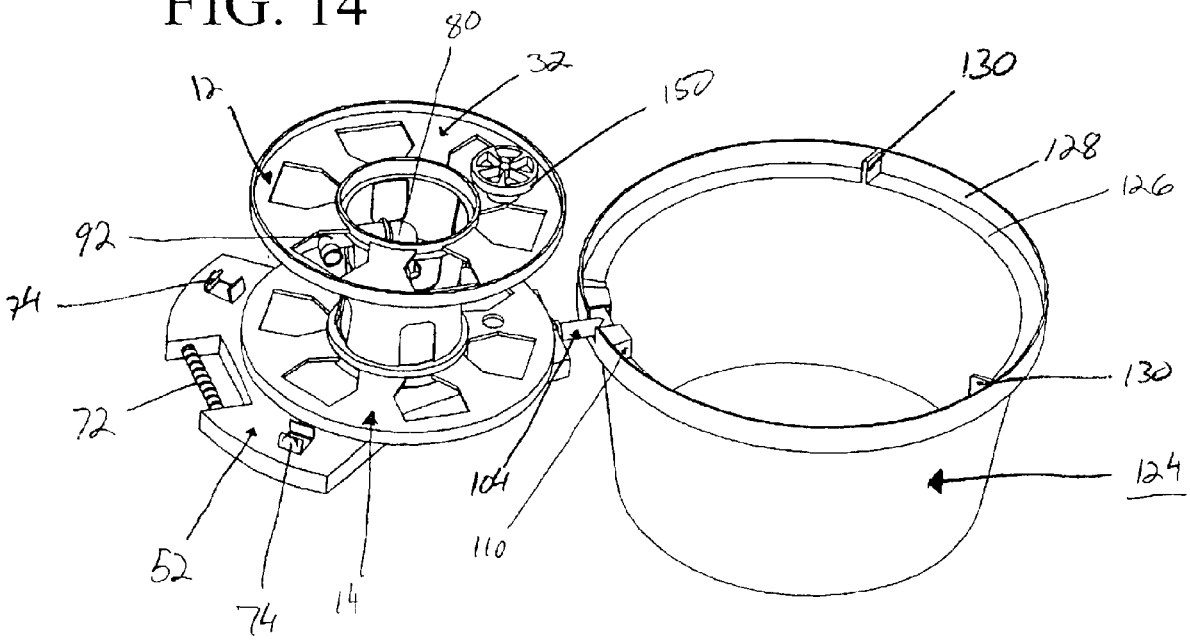
FIG. 14 is a perspective view of one embodiment view of the hose reel system of the present invention with the attachment plate in the extended position.
Figure 15:
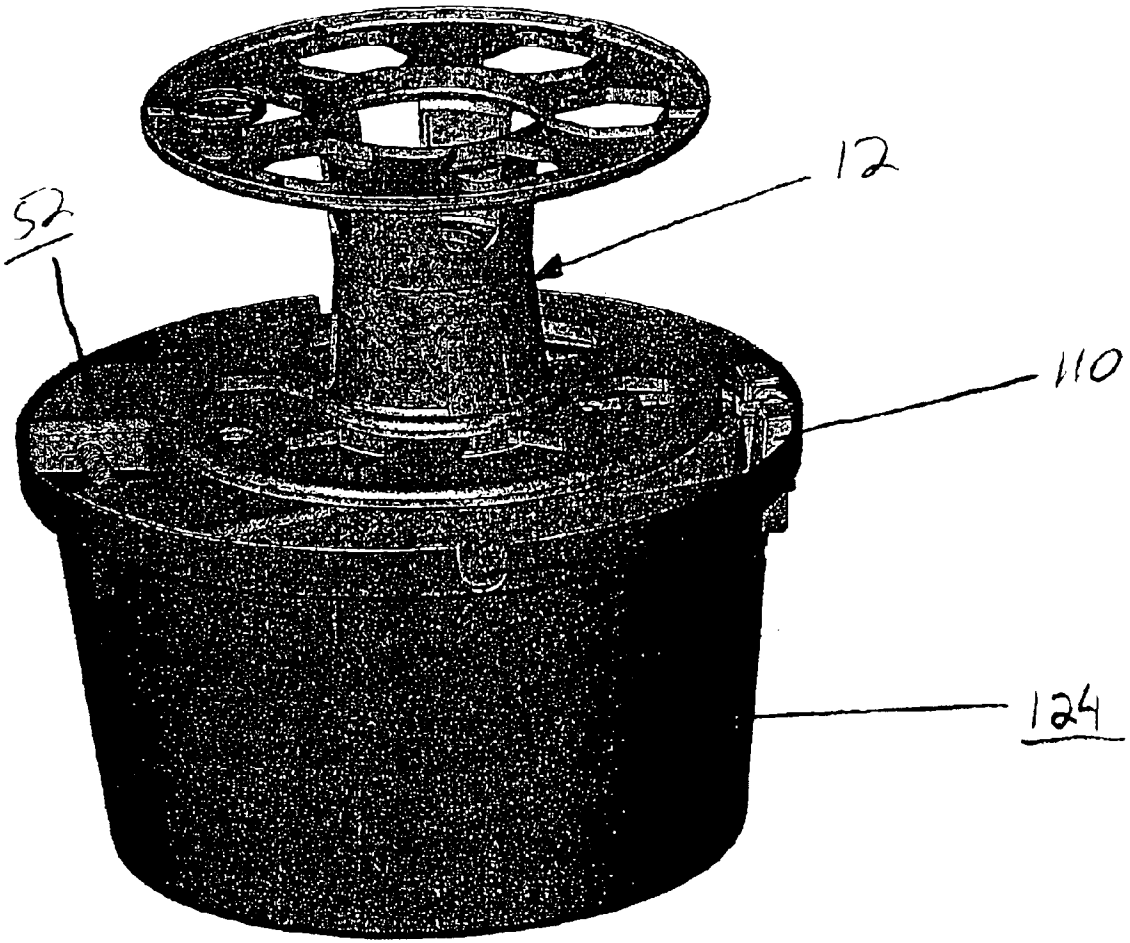
FIG. 15 is a perspective view of one embodiment view of the hose reel system of the present invention with the attachment plate in the seated position, and the attachment plate swiveled in the open position.

The hose reel system 10 is arranged to allow for the hose reel 12 to be placed in multiple positions. When the swivel bar 106 is attached to the attachment plate 52 and the tub 124, it allows the attachment plate 52 to be positioned in both a seated configuration within the tub (as shown in FIGS. 13 and 15) or in an extended position (as shown in FIG. 14). Also, as the attachment plate 52 can rotate around the extending section 106 of the swivel bar, the hose reel 12 which is attached to the attachment plate 52, can be positioned in either an open position (as shown in FIG. 15) or a closed position (as shown in FIG. 13).

The hose reel system 10 is suitably connected to hoses as follows (see FIGS. 13–15). A lead hose, which is attached to a water tap, is attached to the pipe end 92 which is positioned behind the reel guide hub 64. The lead hose can be positioned in the hose grooves 60 of the attachment plate 52, when the attachment plate 52 is in the seated, closed position. A main hose is then attached at one end to the other pipe end 92 which is attached to the central pipe 80. The main hose is then wound around the hose reel 12. It can be wound around the reel 12 by rotating the reel 12, via a handle 150 (which is attached to the reel 12 through the handle aperture 38), around the reel guide hub 64. The other end of the main hose can be clipped in either (or both) of the hose locking tabs 74 when the hose is fully wound and ready for storage.

The hose reel system 10 is suitably used as follows (see FIGS. 13–15). The attachment plate 52 is originally in a seated, closed position (see FIG. 13) with a portion of the attachment plate resting on the inner rim 126 of the tub 124. A user grasps the handle 72 and pivots the attachment plate 52 on the swivel bar 104 into the extended position (see FIG. 14). The user then rotates the attachment plate 52 on the extending section of the swivel bar 104, and pivots the attachment plate 52 back into a seated position, with a portion of the attachment plate resting on the inner rim 126 of the tub 124 (see FIG. 15). A user can now deploy the main hose off of the reel 12. The stationary stops 130 of the tub 124, prevent the attachment plate 52 from twisting in the tub 124 during deployment and retraction of the hose, and help to prevent stress and breakage of the hinge bracket 110 or swivel bar 104.

It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A hose reel system comprising:

a hose reel comprising:

a first reel section comprising a side plate and a hub having a side wall and a top wall, the top wall of the first reel section hub having a center aperture; a second reel section comprising a side plate and a hub having a side wall and a top wall, the top wall of the second reel section hub having a center aperture; wherein the top wall of the first reel section hub is attached to the top wall of the second reel section hub;

an attachment plate having a top wall, a bottom wall, a side wall having a bar receiving aperture, a reel guide hub having a side wall and a top wall, the top wall of the reel guide hub having a center aperture; and wherein the hub of the first reel section receives the reel guide hub.

2. The hose reel system of claim 1 wherein the top wall of the first reel section hub further comprises a plurality of locking tabs and a plurality of locking slots, and the top wall of the second reel section hub further comprises a plurality of locking tabs and a plurality of locking slots; and wherein the top wall of the first reel section hub is attached to the top wall of the second reel section hub via the plurality of locking tabs of the first reel section being inserted into the plurality of locking slots of the second reel section and the plurality of locking tabs of the second reel section being inserted into the plurality of locking slots of the first reel section.

3. The hose reel system of claim 1 wherein the side wall of the attachment plate further comprises a plurality of hose grooves.

4. The hose reel system of claim 1 wherein the attachment plate further comprises a bar supporting rib.

5. The hose reel system of claim 1 wherein the attachment plate further comprises a hose locking tab.

6. The hose reel system of claim 1 wherein the attachment plate further comprises a handle.

7. The hose reel system of claim 1 wherein the system further comprises a swivel bar having an extending section and a top section; and wherein the extending section is received by the bar receiving aperture of the attachment plate.

8. The hose reel system of claim 7 further comprising:

a tub having an outer lip and an inner rim;

a hinge bracket mounted on the inner rim of the tub; and wherein the hinge bracket receives the top section of the swivel bar.

9. The hose reel system of claim 1 further comprising a central pipe which passes through the center aperture of the first reel section hub, the center aperture of the second reel section hub, and the center aperture of the reel guide hub; and wherein the side wall of the hub of the second reel section has a side aperture.

10. The hose reel system of claim 9 wherein the central pipe has a first O-Ring Slot and a second O-Ring slot.

11. The hose reel system of claim 10 wherein the system further comprises a first pipe end having a pipe connecting collar and a hose connecting collar, and a second pipe end having a hose connecting collar and a pipe connecting collar;

wherein the pipe connecting collar of the first pipe end receives the first O-Ring Slot, and the pipe connecting collar of the second pipe end receives the second O-Ring Slot.

12. The hose reel system of claim 11 wherein the pipe connecting collar of the first pipe end is rotatively coupled to the central pipe and the pipe connecting collar of the second pipe end is rotatively coupled to the central pipe.

13. The hose reel system of claim 11 wherein the pipe connecting collar of the first pipe end is rotatively coupled to the central pipe and the pipe connecting collar of the second pipe end is rotatively coupled to the central pipe.

14. A hose reel system comprising:

a hose reel comprising:

a first reel section comprising a side plate and a hub having a side wall and a top wall, the top wall of the first reel section hub having a center aperture; a second reel section comprising a side plate and a hub having a side wall and a top wall, the top wall of the second reel section hub having a center aperture; wherein the top wall of the first reel section hub is attached to the top wall of the second reel section hub;

an attachment plate having a top wall, a bottom wall, a side wall having a bar receiving aperture, a reel guide hub having a side wall and a top wall, the top wall of the reel guide hub having a center aperture;

a swivel bar having an extending section and a top section;

a tub having an outer lip and an inner rim;

a hinge bracket mounted on the inner rim of the tub, wherein the hinge bracket receives the top section of the swivel bar;

wherein the hub of the first reel section receives the reel guide hub; and wherein the extending section of the swivel bar is received by the bar receiving aperture of the attachment plate.

15. The hose reel system of claim 14 wherein the top wall of the first reel section further comprises a plurality of locking tabs and a plurality of locking slots, and the top wall of the second reel section further comprises a plurality of locking tabs and a plurality of locking slots; and wherein the top wall of the first reel section hub is attached to the top wall of the second reel section hub via the plurality of locking tabs of the first reel section being inserted into the plurality of locking slots of the second reel section and the plurality of locking tabs of the second reel section being inserted into the plurality of locking slots of the first reel section.

16. The hose reel system of claim 14 wherein the side wall of the attachment plate further comprises a plurality of hose grooves.

17. The hose reel system of claim 14 wherein the attachment plate further comprises a bar supporting rib.

18. The hose reel system of claim 14 wherein the attachment plate further comprises a hose locking tab.

19. The hose reel system of claim 14 wherein the attachment plate further comprises a handle.

20. The hose reel system of claim 14 further comprising a central pipe which passes through the center aperture of the first reel section hub, the center aperture of the second reel section hub, and the center aperture of the reel guide hub; and wherein the side wall of the hub of the second reel section has a side aperture.

21. The hose reel system of claim 20 wherein the central pipe has a first O-Ring Slot and a second O-Ring slot.

22. The hose reel system of claim 21 wherein the system further comprises a first pipe end having a pipe connecting collar and a hose connecting collar, and a second pipe end having a hose connecting collar and a pipe connecting collar;

wherein the pipe connecting collar of the first pipe end receives the first O-Ring Slot, and the pipe connecting collar of the second pipe end receives the second O-Ring Slot.

* * * * *